United States Patent [19]

Topp et al.

[11] Patent Number: 4,665,342

[45] Date of Patent: May 12, 1987

[54] SCREEN PRINTABLE POLYMER ELECTROLUMINESCENT DISPLAY WITH ISOLATION

[75] Inventors: Mark Topp; Sam Hadden, both of Miami, Fla.

[73] Assignee: Cordis Corporation, Miami, Fla.

[21] Appl. No.: 666,279

[22] Filed: Oct. 29, 1984

Related U.S. Application Data

[63] Continuation-in-part of Ser. No. 627,284, Jul. 2, 1984, Pat. No. 4,614,668.

[51] Int. Cl.[4] ..... H05B 33/10; H05B 33/12; B05D 5/06

[52] U.S. Cl. ..... 313/505; 313/509; 427/66

[58] Field of Search ..... 313/505, 506, 509, 503, 313/511; 427/66

[56] References Cited

U.S. PATENT DOCUMENTS

| | | | |
|---|---|---|---|
| 2,877,371 | 3/1959 | Orthuber et al. | 313/108 |
| 2,925,532 | 2/1960 | Larach | 313/503 X |
| 2,938,135 | 5/1960 | Toulon | 313/108 |
| 2,958,009 | 10/1960 | Bowerman, Jr. | 315/169 |
| 2,969,481 | 1/1961 | Sack, Jr. | 315/169 |
| 3,315,111 | 4/1967 | Jaffe et al. | 313/503 |
| 3,631,286 | 12/1971 | Anderson et al. | 313/505 |
| 4,188,565 | 2/1980 | Mizukami et al. | 313/509 |
| 4,238,793 | 12/1980 | Hochstrate | 340/781 |
| 4,322,720 | 3/1982 | Hughes | 340/825.81 |
| 4,417,174 | 11/1983 | Kamijo et al. | 313/503 X |

OTHER PUBLICATIONS

"Design Guide—Electroluminescent Lighting" by Luminescent Systems, Inc. pp. 1 to 69.

*Primary Examiner*—Palmer C. DeMeo
*Assistant Examiner*—Sandra L. O'Shea
*Attorney, Agent, or Firm*—George H. Gerstman

[57] ABSTRACT

A polymer electroluminescent display is provided which comprises a number of individual light-emitting elements in a selected formation and adapted for excitation from a voltage supply. The formation, which is formed on a substrate, includes copper conductors etched onto the substrate. a plurality of polymer dielectrics with relatively high dielectric constant are screen printed over the conductors, with each dielectric corresponding to an individual light-emitting element. A plurality of light-emitting polymer phosphors are screen printed over the dielectrics with each phosphor corresponding to an individual light-emitting element. A polymer indium oxide light-transmissive conductor is screen printed over each phosphor. A polymer dielectric with a relatively low dielectric constant separates each of the individual light-emitting elements from each other and alleviates cross-talk between the individual light-emitting elements. A conductive silver polymer ink is printed over the light-transmissive conductor with portions of the silver polymer defining window openings for enabling viewing of the phosphor through the light-transmissive layer when the phosphor is excited. Voltage excitation by a dynamic voltage supply across a selected copper conductor and the silver polymer will cause light emission by the light-emitting element at the excited location.

11 Claims, 18 Drawing Figures

SCREEN PRINTABLE POLYMER ELECTROLUMINESCENT DISPLAY WITH ISOLATION

This is a continuation-in-part of U.S. application Ser. No. 627,284, filed July 2, 1984, now U.S. Pat. No. 4,614,668, issued Sept. 30, 1986.

BACKGROUND OF THE INVENTION

The present invention concerns a novel electroluminescent display and, more particularly, an electroluminescent display formed of a matrix of individual light-emitting elements in a row and column formation and adapted for excitation from a voltage supply which addresses the matrix.

Prior art electroluminescent displays are known in which the elements which make up the display layered onto a glass substrate. Typically these elements are applied to the glass substrate using vacuum deposition techniques. Such vacuum deposition techniques require expensive equipment, including an expensive vacuum chamber with high temperature deposition, for example, in the order of 600 C. or higher. Because of the high temperature required, the types of substrates which may be utilized are severely limited. Only certain glass materials are typically used because otherwise there could be significant distortion. Other problems may be created by using vacuum deposition techniques, including pinholing (where there are voids in coverage). Further, the process typically takes an extremely long time to complete the assembly of the electroluminescent display using vacuum deposition/high temperature techniques. Because of the size and expense of the vacuum deposition equipment required, only limited quantities of the displays may be produced over a selected period of time.

We have discovered a novel electroluminescent display that alleviates many of the problems concomitant with electroluminescent displays that are formed using vacuum deposition techniques. According to our invention, an electroluminescent display may be provided without using vacuum deposition techniques and without high temperature requirements.

It is an object of the present invention to provide an electroluminescent display that can be miniaturized into an appropriate form usable in a pixel type arrangement.

Another object of the present invention is to provide an electroluminescent display that can be made in large formats for public displays, such as scoreboards, advertisements, etc.

Another object of the present invention is to provide an electroluminescent display that can be addressed in a row and column matrix, thereby allowing for the development of appropriate selection of pixels for alphanumeric or other display purposes.

A further object of the present invention is to provide an electroluminescent display that can address mutisegmented digits.

A still further object of the present invention is to provide an electroluminescent display that can be manufactured efficiently, using printed circuit and screen printing techniques, in contrast to prior art thin film sputtering techniques on high temperature glass substrates.

An additional object of the present invention is to provide an electroluminescent display that can be assembled into an extremely thin (for example, less than 0.02 inch) structure and may be flexible in both directions.

Another object of the present invention is to provide an electroluminescent display that can be formed on a large number of different substrates, including relatively thin substrates and also including substrates which cannot normally withstand high temperatures. For example, such substrates which can be used with our invention include conventional fiberglass printed circuit board material, phenolic boards, substrates formed of polyamide film, substrates formed of polycarbonate, substrates formed of fluorohalocarbon film, and others. By the nature of the aforementioned substrates and the elements used in the present invention, the entire electroluminescent display may be flexible and may be extremely thin (for example, less than 0.02 inch).

A still further object of the present invention is to provide an electroluminescent display that can be manufactured using screen printing techniques, with the elements forming the display being curable at low temperatures, such as under 150° C. The substrate may include conventional fiberglass printed circuit board material, a substrate formed of phenolic material, a substrate formed of polyamide film, a substrate formed of polycarbonate, a substrate formed of fluorohalocarbon film, and others. Such substrates used in accordance with the present invention are 0.005 inch in thickness and may be as thin as 0.001 inch if desired.

A further object of the present invention is to provide an electroluminescent display in which the individual light-emitting elements forming the electroluminescent display are effectively isolated from each other.

An additional object of the present invention is to provide an electroluminescent display that effectively operates in the form of light-emitting capacitors, in a manner that provides significant advantages over prior art electroluminescent display techniques.

Other objects and advantages of the present invention will become apparent as the description proceeds.

SUMMARY OF THE INVENTION

In accordance with the present invention, an electroluminescent display is provided comprising a matrix of individual light-emitting elements in a row and column formation and adapted for excitation from a voltage supply which addresses the matrix. The matrix is formed on a substrate and each of the light-emitting elements comprises a first electrical conductor overlying the substrate, a dielectric overlying the first electrical conductor, a light-emitting phosphor overlying the dielectric, and a second electrical conductor overlying the phosphor and defining a window for enabling viewing of the phosphor. In this manner, the voltage excitation by the voltage supply across the first electrical conductor and the second electrical conductor will cause light emission by the excited element.

In the illustrative embodiment, the first conductor comprises a copper layer, the dielectric comprises a polymer barium titanate layer, the phosphor comprises a phosphor polymer layer and the second electrical conductor comprises a conductive silver polymer ink. A light-transmissive polymer electrically conductive layer overlies the phosphor with the second electrical conductor overlying the light-transmissive layer.

In the illustrative embodiment, a second polymer dielectric separates each of the individual light-emitting elements from each other. The second polymer dielectric has a dielectric constant that is substantially lower than the dielectric constant of the polymer dielectrics which overlie the first conductors and correspond to individual light-emitting elements. The second polymer dielectric with a relatively low dielectric constant is useful to alleviate a cross-talk problem between individual light-emitting elements.

In the illustrative embodiment, the first electrical conductors are electrically interconnected to form a column and the second electrical conductors are electrically interconnected to form a row. A plurality of parallel columns are on the substrate and there is also a plurality of parallel rows on the substrate, with the columns and rows being perpendicular to each other.

A more detailed explanation of the invention is provided in the following description and claims, and is illustrated in the accompanying drawings.

DETAILED DESCRIPTION OF THE ILLUSTRATIVE EMBODIMENT

Figure 1:
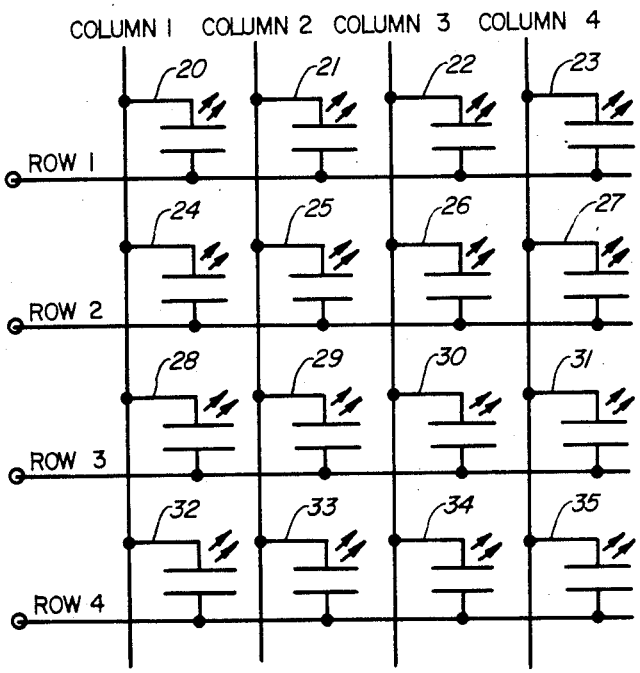
FIG. 1 is a schematic diagram of a matrix of light-emitting elements in accordance with the principles of the present invention.

In FIG. 1 there is shown, schematically, a 4×4 matrix of individual light-emitting elements 20 through 35 in a row and column formation. Elements 20 through 23 are in row 1; elements 24 through 27 are in row 2; elements 28 through 31 are in row 3; and elements 32 through 35 are in row 4. Elements 20, 24, 28 and 32 are in column 1; elements 21, 25, 29 and 33 are in column 2; elements 22, 26, 30 and 34 are in column 3; and elements 23, 27, 31 and 35 are in column 4. Elements 20 through 35 are adapted for excitation from a voltage supply which addresses the matrix, as is discussed below. Elements 20 through 35 are individual pixel points which effectively are capacitors in an array matrix form. Although a 4×4 matrix is illustrated, no limitation is intended with respect to the size of the array matrix. Furthermore, the configuration of thematrix can be such that multi-segment digits can be formed, both multiplexed or direct addressing, and also luminous fixed legends, such as logos, nomenclature, etc. may be used.

Figure 2:
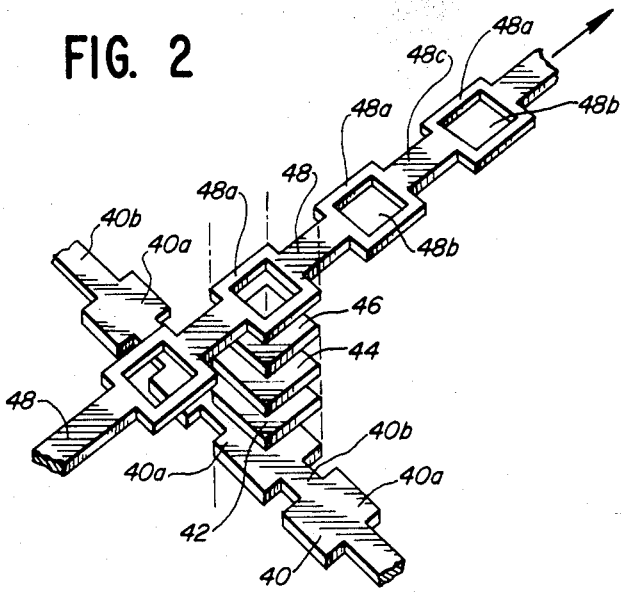
FIG. 2 is a partially broken, exploded, perspective view of a portion of an electroluminescent display constructed in accordance with the principles of the present invention.
Figure 9:
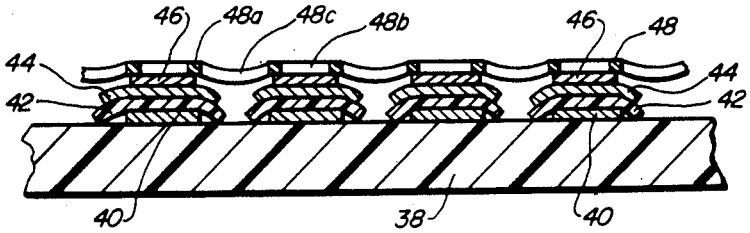
FIG. 9 is a diagrammatic cross-sectional view, taken along the plane of the line 9—9' of FIG. 3.

The construction of the matrix can be most readily understood by referring to FIG. 2, which shows an exploded perspective view of a portion of the matrix that is printed upon a suitable non-conductive substrate 38 (FIG. 9). FIG. 2 shows a typical pixel at the intersection of one row and one column and includes a foil copper conductor layer 40 overlying the substrate, a polymer barium titanate dielectric polymer 42 overlying the copper conductor, a phosphor polymer layer 44 overlying the dielectric, a polymer indium oxide translucent polymer conductor 46 overlying the phosphor polymer layer, and a silver polymer electrical conductor 48 overlying the indium oxide translucent polymer. It can be seen that the copper conductor layer 40 comprises a number of large portions **40*a* interconnected by smaller portions 30*b*. Interconnected portions 40*a* and 40*b* form a column, with one of the larger portions 40*a* being the first printed layer of a pixel. It can also be seen that silver polymer conductor 48 comprises large portions 48*a* defining open windows 48*b* and interconnected by smaller portions 48*c*. The interconnected large portions 48*a* and smaller portions 48*c* form a row with one of the large portions 48*a* and its defined window 48*b*** being the top layer of a pixel.

Figure 3:
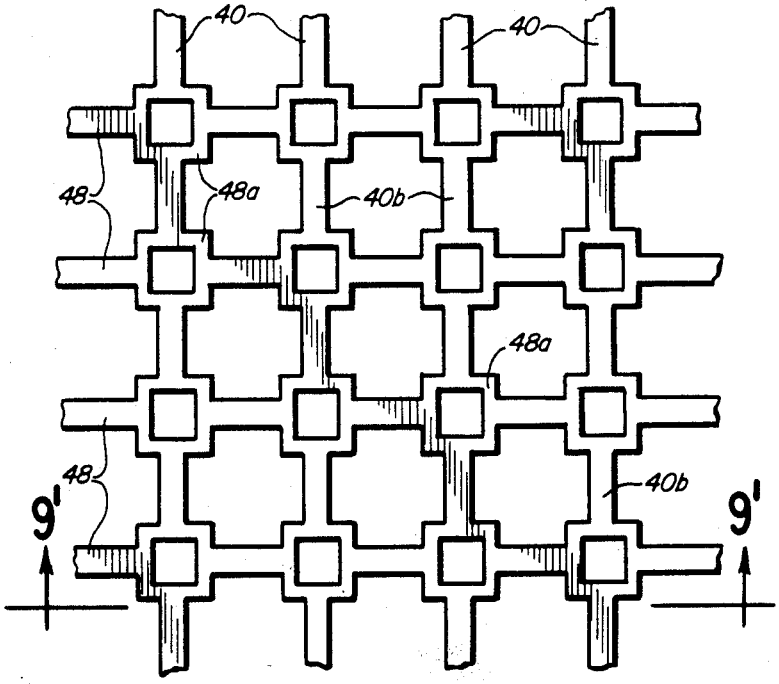
FIG. 3 is a partially broken plan view of an electroluminescent display constructed in accordance with the principles of the present invention.

Referring to FIG. 3, it can be seen that four copper conductor layers 40 are aligned in parallel, spaced relationship to form four columns and four silver polymer conductors 48 are aligned in spaced parallel relationship to each other to form four rows, with the rows and columns being perpendicular to each other and forming an array matrix. Voltage excitation by a voltage supply across a selected copper conductor 40 and a selected silver polymer conductor 48 will cause light emission by the light-emitting element at the excited row-column intersection, with the phosphor pixel emitting light which is viewed through the pixel window **48*a***.

Figure 4:
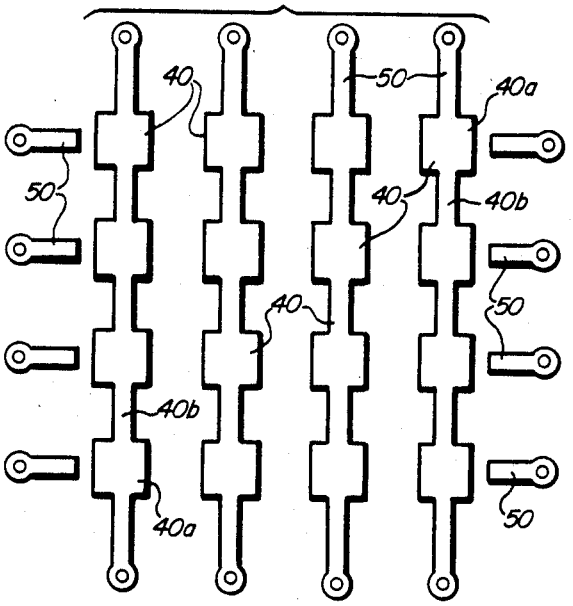
FIG. 4 is a layout diagram of the first electrical conductor of an electroluminescent display constructed in accordance with the principles of the present invention.

FIGS. 4–8 show, in diagrammatic form, the steps of providing the appropriate layers on the substrate. Referring to FIG. 4, the parallel copper layers 40 are provided on a substrate using conventional printed circuit board technology to provide an etched copper pattern as illustrated. End connectors 50 are also etched on the substrate for subsequent contact with the ends of the parallel silver polymer layers. As a specific example, the copper layer may be 0.0012 inch in thickness.

Figure 5:
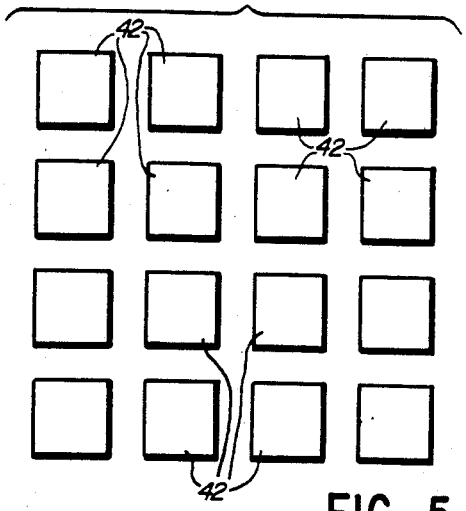
FIG. 5 is a similar layout diagram of the polymer dielectric.

Referring to FIG. 5, a barium titanate dielectric layer 42 is then screen printed on top of the copper layer 40. As a specific example, the dielectric 42 may be about 0.0017 inch in thickness. The dielectric is cured at 105 C. for twenty minutes, and comprises several deposits (with curing between each deposit) to form the 0.0017 inch total layer.

Figure 6:
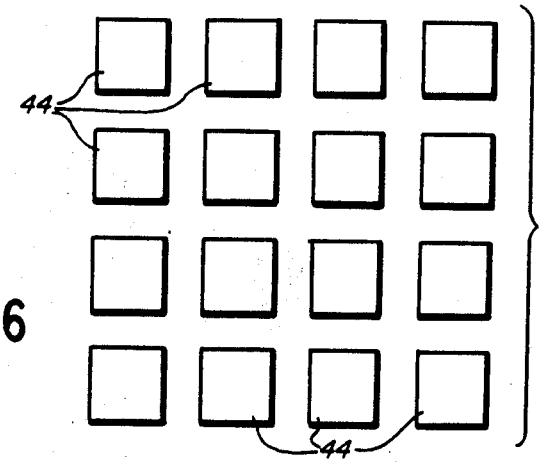
FIG. 6 is a similar layout diagram of the polymer phosphorous layer.

Referring to FIG. 6, a phosphorous layer 44, formed of a suitable phosphor polymer, is screen printed over the dielectric 42. In a specific example, the phosphor polymer layer is about 0.0017 inch in thickness and it is cured at 105° C. for thirty minutes.

Figure 7:
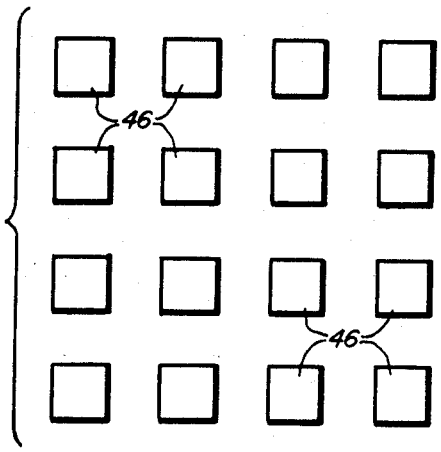
FIG. 7 is a similar layout diagram of the polymer indium oxide layer.

Referring to FIG. 7, an indium oxide translucent polymer 46, which is electrically conductive, is screen printed over phosphorous layer 44. In a specific example, the indium oxide translucent polymer conductor is approximately 8 microns in thickness, and it is cured at 65° C. for twenty minutes.

Figure 8:
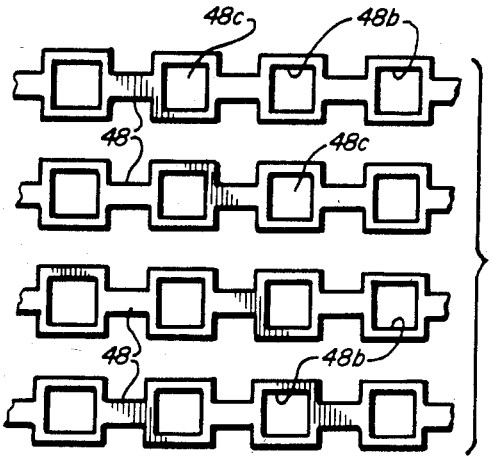
FIG. 8 is a similar layout diagram of the silver polymer ink layer.

Referring to FIG. 8, the silver polymer conductor rows 48 are screen printed on top of the indium oxide layers 46 with each defined window **48*b* directly overlying an indium oxide conductor 46. In a specific example, the interconnecting silver conductor 48 is about 15 microns in thickness, and it is cured 150° C. for ninety minutes. It is deposited with a 200 mesh/inch screen, in a single deposit, and the ends of the silver conductors 48 overlie and make contact with copper elements 50**, to which interconnecting wires may be soldered.

Referring to FIG. 7, it should be noted that the pattern for the indium oxide elements 46 provides slightly smaller indium oxide squares than the barium titanate dielectric squares 42 and the phosphorous squares 44. This is because the indium oxide layer is electrically conductive and by making the indium oxide squares smaller than the dielectric and phosphorous squares, there will be no short circuit between the copper layers 40 and the indium oxide 46. In this manner, each pixel effectively comprises a capacitor with a barium titanate dielectric layer 42 and a phosphorous layer 44 sandwiched between conductors.

In an alternative embodiment, the silver polymer conductor 48 is screen printed directly over the phosphor polymer 44 and the indium oxide translucent polymer conductor 46 is deposited over the silver polymer conductor 48.

In FIG. 9, there is a cross-sectional view of a row from FIG. 3. To cause the light emission by a pixel, a dynamic voltage is provided across the selected row and selected column to excite the pixel at the row-column intersection. The dynamic voltage may be provided by an alternating current or a pulsed direct current. In a specific example, a pulsed direct current was applied using one-eighth duty cycle rectangular waves at 20 kilohertz having a voltage between 250 and 300 volts. It is to be understood, however, that the parameters of the dynamic voltage that is applied across a row and column can vary considerably. However, using the aforementioned parameters, the pixel emitted a blue cyan color light. This color is pleasing to the eye and is also adaptable for use as the blue phosphor in a color television picture tube.

Figure 10:
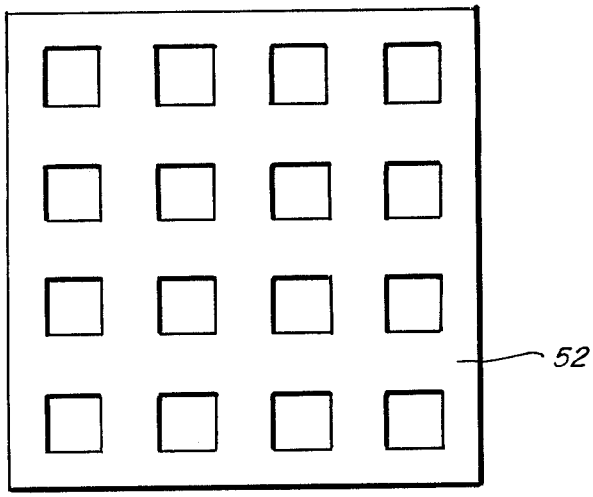
FIG. 10 is a layout diagram of a low dielectric constant polymer dielectric layer.
Figure 12:
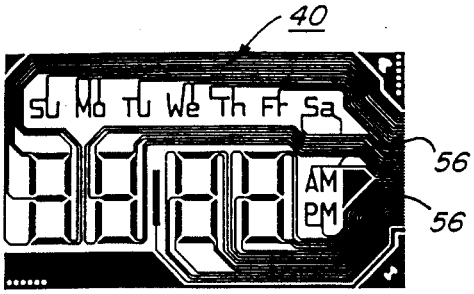
FIG. 12 is a view of the first electrical conductors of an electroluminescent display constructed in accordance with the principles of an embodiment of the present invention.

It has been found that on occasion there is a cross-talk problem between individual light-emitting elements. The cross-talk problem comprises a light emission between individual light-emitting elements, i.e., a "bleeding" of the light, which prevents each of the individual light-emitting elements from being distinct from the others. In order to alleviate the cross-talk problem, referring to FIG. 10 a second polymer dielectric layer 52 is screen printed directly over the copper layer 40. Polymer dielectric 52 is a relatively low-K type dielectric, that is, it has a dielectric constant that is substantially lower than the dielectric constant of relatively high-K polymer dielectric 42. Low-K polymer dielectric 52 cover the areas which are not covered by the copper layer 40. In other words, low-K polymer dielectric layer 52 is effectively the negative of the copper layer. This is shown most clearly by referring to FIGS. 12 and 13. FIG. 12 illustrates the printed copper layer 40 in an embodiment in which a clock face is formed while FIG. 13 illustrates the low-K polymer dielectric layer 52 which is screen printed over copper layer 40 of FIG. 12 and by which the low-K polymer dielectric fills the spaces on the substrate that are not copper.

While the barium titanate dielectric polymer layer 42 has a dielectric constant that is greater than 10, preferably 12 to 15, the low-K polymer dielectric layer 52 has a dielectric constant that is lower than 5, preferably 3 or less.

It is preferred that the low-K polymer dielectric 52 be screen printed over the first conductor layer 40, before the relatively high-K dielectric layer 42 is printed. In addition, it has been found useful to print the low-K dielectric in other fill-in areas, such as between the phosphor elements, in order to provide a most effective isolation of the individual light-emitting elements and thus alleviate the cross-talk problem.

Figure 16:
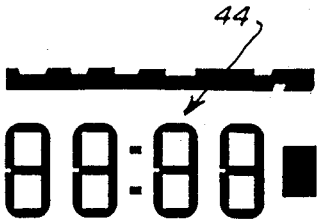
FIG. 16 is a similar view of the phosphor layer.
Figure 13:
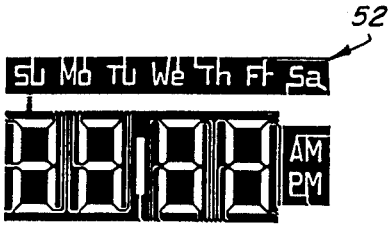
FIG. 13 is a similar view of a low-K value dielectric layer.
Figure 17:
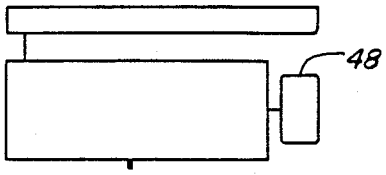
FIG. 17 is a similar view of the silver polymer ink layer.
Figure 14:
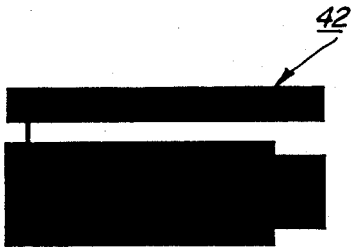
FIG. 14 is a similar view of a high-K value dielectric layer.
Figure 18:
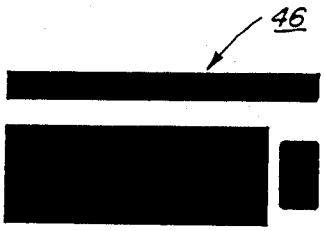
FIG. 18 is a similar view of the polymer indium oxide layer.
Figure 15:
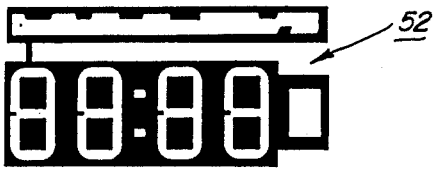
FIG. 15 is a similar view of another low-K value dielectric layer.

FIGS. 12–18 show the layers utilized in printing an electroluminescent display comprising a clock face. As stated above, FIG. 12 comprises copper conductor layer 40; FIG. 13 comprises low-K polymer dielectric layer 52 which is printed over layer 40 of FIG. 12; FIG. 14 illustrates the high-K polymer dielectric layer 42 which is screen printed over layer 52; FIG. 15 comprises another low-K polymer dielectric layer 52' which is screen printed over layer 42; FIG. 16 comprises a phosphor polymer layer 44 which is printed over the low-K polymer dielectric layer of FIG. 15; FIG. 17 comprises the silver polymer electrical lines 48 which are printed over the phosphor layer 44; and FIG. 18 illustrates the indium oxide translucent polymer layer 46 that is printed over phosphor polymer layer 44 of FIG. 16.

Voltage excitation at a voltage supply across a selected copper conductor 40 and silver polymer line 48 will cause light emission by the light-emitting element at the excited location. For example, the application of an appropriate voltage across line 56 (FIG. 12) and silver conductive line 48 (FIG. 17) will result in illumination of the "AM" on the clock face.

Figure 11:
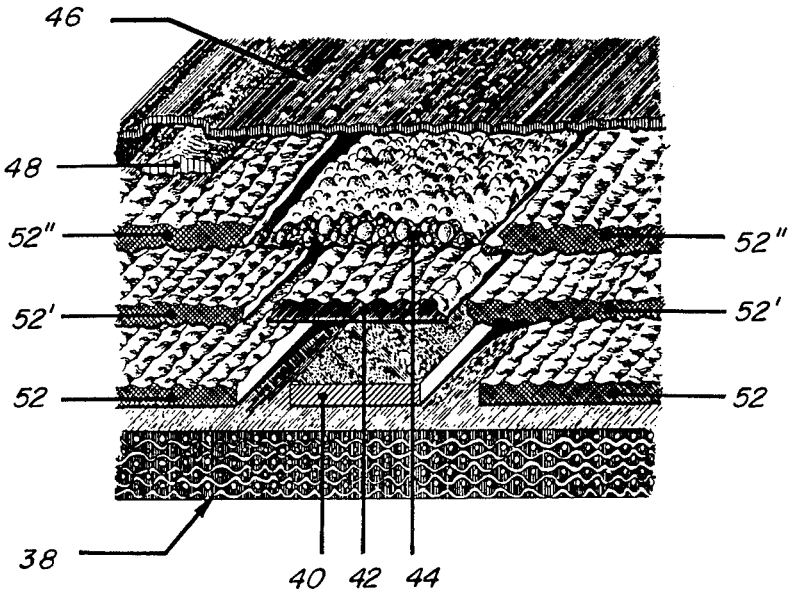
FIG. 11 is an exploded perspective view of a portion of an electroluminescent display constructed in accordance with the principles of one embodiment of the present invention.

Referring to FIG. 11, an exploded perspective view of an individual light-emitting element is illustrated therein. The reference numerals correspond to those numerals which are used and discussed above. Thus substrate 38 may be any suitable substrate, including a fiberglass printed board material, polyamide, polycarbonate, fluoro-halo carbon. First conductor 40 may be a copper conductor, but could also be another suitable conductor such as gold, silver, etc. that is deposited, etched or plated onto the substrate 38. Low-K polymer dielectric 52 is utilized, as stated above, for electrical field isolation and may, if desired, be a standard valued K dielectric. Polymer dielectric 42, which overlies first conductor 40, must be a high-K value dielectric. Reference numerals 52' and 52'' also designate low-K value dielectrics. Reference numeral 44 designates the polymer phosphor which are phosphor crystals embedded in a polymer binder such as Emca 3451-2, manufactured by Electromaterials Corporation of America, Mamaroneck, N.Y. Reference numeral 48 designates a polymer silver conductor, part of the top conductor of the anode (which can be of any shape, width or design depending on the application). Reference numeral 46 designates the indium oxide translucent polymer, which can be formed of various widths and lengths.

In a specific example, although no limitations are intended, polymers which may be used in the present invention are manufactured by Electromaterials Corporation of America.

It can be seen that in the illustrative embodiments, thick film techniques, including etching and screen printing, have been used, in contrast to thin film techniques vacuum sputtering and the like. The materials are effectively sealed to prevent moisture from attacking the phosphorous layer.

Although an illustrative embodiment of the invention has been shown and described, it is to be understood that various modifications and substitutions may be made by those skilled in the art without departing from the novel spirit and scope of the present invention. For example, the display may be various fixed legends such as a company logo, a clock face, test equipment instrumentation, automatic instrumentation, medical instrumentation, etc.

What is claimed is:

1. A polymer electroluminescent display which comprises:

a number of individual light-emitting elements in a selected formation and adapted for excitation-from a voltage supply;

said elements being formed on a substrate and said display comprising a first electrical conductor overlying the substrate;

a first polymer dielectric located complementary with the first electrical conductor and separating each of the individual light-emitting elements from each other, said first dielectric polymer having a relatively low dielectric constant;

a second polymer dielectric having a dielectric constant that is substantially higher than the dielectric constant of said first polymer dielectric;

a light-emitting phosphor polymer overlying said second dielectric;

a second electrical conductor overlying the phosphor and defining a window for enabling viewing of the phosphor;

whereby voltage excitation by the voltage supply across the first electrical conductor and the second electrical conductor will cause light emission by the excited phosphor polymer.

2. A display as described in claim 1, in which said first polymer dielectric has a dielectric constant below 5 and said second polymer dielectric has a dielectric constant above 10.

3. A display as described in claim 1, wherein said first conductor comprises a copper layer.

4. A display as described in claim 1, wherein said second polymer dielectric comprises a polymer barium titanate layer.

5. A display as described in claim 1, wherein the display is less than 0.020 inch in thickness, including the substrate thickness.

6. A display as described in claim 1, in which the display is substantially flexible in opposite directions.

7. A display as described in claim 1, including a light-transmissive electrically layer overlying said phosphor polymer, and said second electrical conductor overlying said light-transmissive layer.

8. A display as described in claim 7, wherein said light-transmissive electrically conductive layer comprises a polymer indium oxide.

9. A display as described in claim 1, said second electrical conductor comprising a conductive silver polymer ink.

10. A polymer electroluminescent display which comprises:

a matrix of individual light-emitting elements formed in columns that are parallel to each other and rows that are parallel to each other, with the columns and rows being perpendicular to each other and with the formation of columns and rows being adapted for excitation from a voltage supply which addresses the matrix;

said matrix being formed on a substrate and each of said light-emitting elements comprising a first electrical conductor overlying the substrate;

a first polymer dielectric located complementary with the first electrical conductor and separating each of the individual light-emitting elements from each other, said first dielectric polymer having a relatively low dielectric constant;

a second polymer dielectric having a dielectric constant that is substantially higher than the dielectric constant of said first polymer dielectric;

a light-emitting phosphor polymer overlying said second dielectric;

a second electrical conductor overlying the phosphor and defining a window for enabling viewing of the phosphor;

whereby voltage excitation by the voltage supply across the first electrical conductor and the second electrical conductor will cause light emission by the excited phosphor polymer.

11. A process for making a polymer electroluminescent display comprising a number of individual light-emitting elements in a selected formation and adapted for excitation from a voltage supply, which comprises the steps of:

providing an electrically non-conductive substrate;

providing a copper foil layer on said substrate which comprises a pattern including the light-emitting elements in the general configuration of the desired display;

screen printing a first polymer dielectric complementary with said copper foil layer to separate each of the light-emitting elements from each other, said first polymer dielectric layer having a relatively low dielectric constant;

screen printing a barium titanate dielectric layer, said barium titanate dielectric layer having a dielectric constant that is substantially higher than the dielectric constant of said first dielectric;

screen printing a light-emitting phosphor polymer overlying the second dielectric layer;

screen printing an indium oxide transmissive conductor layer over said phosphor polymer layer;

screen printing an electrically conductive silver polymer ink over said indium oxide transmissive conductive layer with said electrically conductive silver polymer ink defining a window enabling viewing of the light-emitting phosphor;

whereby voltage excitation by the voltage supply across the copper foil layer and the silver polymer ink will cause light emission by the excited phosphor polymer.

* * * * *